United States Patent [19]

Ogihara et al.

[11] 4,400,091

[45] Aug. 23, 1983

[54] SECOND STOP DEVICE OF CLOCK

[75] Inventors: Masuo Ogihara; Nobuo Shinozaki; Tadashi Ishikawa; Toshio Yamamoto Yoichi Seki, all of Shikawatashi, Japan

[73] Assignee: Seiko Koki Kabushiki Kaisha, Tokyo, Japan

[21] Appl. No.: 231,797

[22] Filed: Feb. 5, 1981

[30] Foreign Application Priority Data

Feb. 5, 1980 [JP] Japan ..... 55/13093[U]

[51] Int. Cl.[3] ..... G04B 19/04

[52] U.S. Cl. ..... 368/80

[58] Field of Search ..... 368/69, 76, 80, 155–157, 368/160, 184, 185, 187, 190–192

[56] References Cited

U.S. PATENT DOCUMENTS

| | | | |
|---|---|---|---|
| 2,713,764 | 7/1955 | Vaulpt | 368/155 |
| 2,995,888 | 8/1961 | Ryan | 368/185 |
| 3,059,412 | 10/1962 | Edderlein | 368/185 |
| 3,262,259 | 7/1966 | Bennett et al. | 368/185 |
| 3,665,698 | 5/1972 | Dome | 368/185 |
| 3,731,481 | 5/1973 | Nakatama | 368/185 |
| 4,050,234 | 9/1977 | Toshio | 368/185 |

FOREIGN PATENT DOCUMENTS

| | | | |
|---|---|---|---|
| 1094666 | 12/1960 | Fed. Rep. of Germany | 368/185 |

*Primary Examiner*—Vit W. Miska

*Attorney, Agent, or Firm*—Robert E. Burns; Emmanuel J. Lobato; Bruce L. Adams

[57] ABSTRACT

A timepiece has a second hand, a minute hand and an hour hand which are rotationally driven by a gear train under control of an electromechanical transducer. The transducer has a plastic coil frame on which is wound a coil and electric drive signals are applied to the coil in response to which the transducer produces a rotational output for driving the gear train. A hand stopping device is formed integrally with the coil frame and functions to temporarily stop the rotational movement of the gear train to thereby enable setting or correction of the position of the second hand. The device comprises a flexible arm formed integrally with and projecting from the coil frame, the arm having a manually operated portion in the form of a button which, when actuated, resiliently flexes the arm from an inoperative position to an operative position, and an interlocking portion operable when the arm is flexed to its inoperative position to releaseably interlock with a gear of the gear train to thereby stop the rotational movement of the gear train.

11 Claims, 4 Drawing Figures

FIG. 1
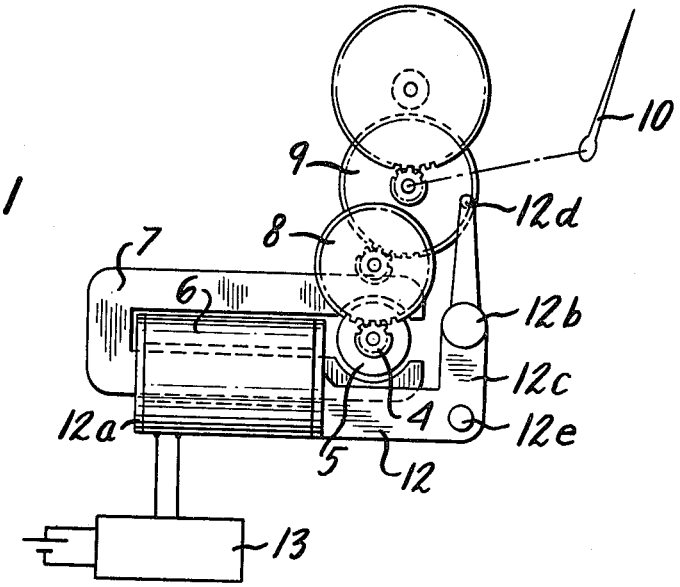
FIG. 2
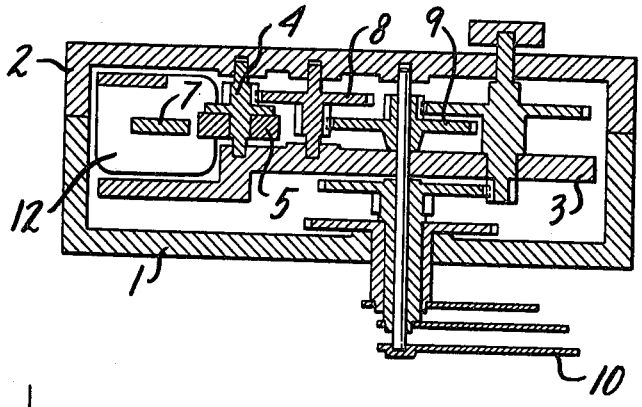
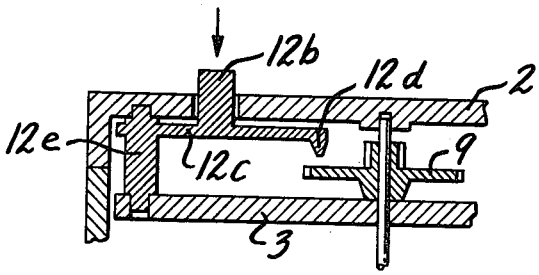
FIG. 3
FIG. 4
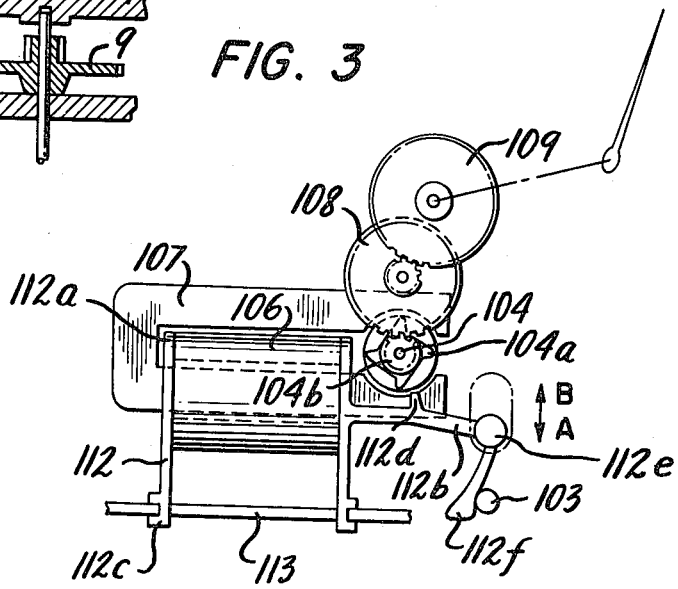

SECOND STOP DEVICE OF CLOCK

BACKGROUND OF THE INVENTION

The present invention relates to an improvement of a second stop device for an electrical clock having a second hand in which the rotational movement of the second hand may be mechanically restricted or stopped.

In a highly precise timepiece, such as a crystal clock with a second hand, an accuracy in time units of a second is requisite for performing the timekeeping operation of the clock, and thus a second stop device is provided to enable a correct setting of the second hand when the time is to be corrected or set to a standard time. In a conventional type of second stop device, it is generally known that a second stop lever for use in preventing a rotation of a gear of a gear train which drives a set of clock wheels and thereby stopping the second hand is arranged or provided independently, so that the conventional system has such disadvantages as a large number of component parts and a large number of steps of assembling the clock.

SUMMARY OF THE INVENTION

According to the present invention, a coil frame for a motor coil which is used in an electric clock is made of a plastic material, and both a winding part for the coil and a second stop device are integrally formed with each other, resulting in a second stop device having fewer parts and less assembly steps as compared to the prior art.

BRIEF DESCRIPTION OF THE DRAWINGS

FIG. 1 is a top plan view illustrating a first preferred embodiment of the present invention.

FIG. 2 is a sectional view of FIG. 1.

FIG. 3 is a sectional view of a second stop part shown in FIG. 1.

FIG. 4 is a top plan view illustrating a second preferred embodiment of the present invention.

Referring now to the drawings, a preferred embodiment of the present invention will be described.

In the first preferred embodiment shown in FIGS. 1 to 3, a front case (1), a rear case (2) and a partition plate (3) are arranged to rotatably mount the shafts of a gear train, and the cases and plates are connected with each other by any suitable means (not shown). A stepping motor comprises a rotor (4) having a permanent magnet (5) fixed thereto, and a coil (6) and stator (7) which are energized by a driving pulse generated by an electric circuit (13) once every second, and the stepping motor is constructed such that the rotor (4) is rotated in a stepwise manner in increments of 180°. The stepping motor comprises an electromechanical transducer for converting the electric drive pulses generated by the electric circuit (13) into mechanical rotary motion and the rotary movement of said rotor (4) is transmitted to a driving wheel (8) and a second hand wheel (9) so that a second hand (10) fixed at a leading end of the shaft of said second hand wheel (9) is moved in a step-wise manner. Further, the rotation of the second hand wheel (9) is transmitted through a well-known type of gear train construction such as an intermediate gear, a minute hand gear, an intermediate hour wheel and an hour hand wheel. A coil frame (12) on which said coil (6) is wound has a winding part (12*a*), a button (12*b*) which projects out of the rear case (2) and which may manually be operated, an elongate flexible arm (12*c*) which may be elastically deformed of flexed by operating said button, a projection (12*d*) arranged at a leading end of said arm (12*c*) and having a friction face for frictionally interlocking with the gear (9) so as to prevent rotation of the second hand gear (9), and a shaft (12*e*) fitted to said rear case (2) and the partition plate (3) to set the position of the coil frame (12), the coil frame being integrally formed of resilient or flexible plastic material. The projection (12*d*) in the coil frame is made such that the arm (12*c*) is resiliently deformed or flexed when the button (12*b*) is operated in a direction shown by the arrow in FIG. 3 so as to perform a second stop operation. When the button is depressed, the arm (12*c*) moves to its operative position to cause the projection (12*d*) to frictionally engage with the second hand wheel (9) to prevent a rotation of the second hand wheel (9) and when the operation of the button (12*b*) is terminated, the projection (12*d*) returns to its inoperative position due to the resiliency of the arm (12*c*) and thus moves out of engagement with the second hand wheel (9). Therefore, during such a time as the button (12*b*) in the coil frame is being depressed to its operative position, the second hand (10) is stopped in order to prevent a rotation of the second hand wheel (9) caused by the stepping motor due to the frictional force exerted between the projection (12*d*) and the second hand wheel (9) and further, when the button (12*b*) is released, the second hand wheel (9) and the projection (12*d*) disengage from each other so that the second hand (10) may resume rotation. The flexible arm (12*c*) is thus configured so as to have a manually operable portion (12*b*) in the form of a depressable button and an interlocking portion (12*d*) in the form of a projection which engages with one gear of the gear train when the arm (12*c*) is moved from its inoperative rest position (show in FIG. 3) to its operative position in response to actuation of the manually operable portion (12*b*). The frictional force may be increased by making a rough surface of the engagement part between the second hand wheel (9) and the projection (12*d*) or by arranging rolet and thereby a rotation of the second hand wheel (9) may be prevented.

Referring now to FIG. 4, a second preferred embodiment of the present invention will be described.

In the second preferred embodiment, rotation of the stepping motor comprised of a rotor (104), a stator (107) and a coil (106) is transmitted to both a driver wheel (108) and a second hand wheel (109) in the same manner as in the first preferred embodiment. A claw wheel (104*a*) for engaging with a projection or claw part (112*d*) of the coil frame to be described later is integrally formed with a rotor cam (104*b*) on the rotor (104). The coil frame (112) on which said coil (106) is wound has a winding part (112*a*), an elongate flexible arm (112*b*) for preventing rotation of said rotor (104) and a fixing part (112*c*) for mounting the coil frame (112) on a base circuit plate (113), all of which parts are integrally formed of suitable plastic materials. Further, the arm (112*b*) of the coil frame has the projection or claw (112*d*) for preventing a rotation of said rotor (104), a button part (112*e*) which may be operated from outside the timepiece and used for displacing the arm (112*b*), and a click part (112*f*) for stopping the claw wheel (104*a*) of said rotor and said claw part (112*d*) at two positions of their engagement and disengagement. The click part (112*f*) of the coil frame exhibits a click action in conjunction with the pin (103) and may move the button part (112*e*) up to two positions A and B in FIG. 4 and may be stopped at either one of the positions. Further, when said button part (112*e*) is placed at the position A, said claw (112*d*) and said claw wheel (104*a*) are disengaged and when placed at the position B, the claw (112*d*) is moved into the rotary locus of the claw wheel (104*a*) to engage therewith and prevent a rotation of the rotor (104). Since the arm (112*b*) of the coil frame is made as a thin piece, said button part (112*e*) may be displaced to either one of the positions A and B without any damage due to the resilient deformation of the plastic arm (112*b*).

Thus, when said button part (112*e*) is placed at the position B, the rotor (104) is prevented from being rotated, so that the second hand wheel (109) may be stopped; and the rotor (104), the driving wheel (110) and the second hand wheel (109) resume operation by displacing the button from the position B to the position A. In this embodiment, the flexible arm (112*b*) has a manually operable portion (112*e*) in the form of a button and an interlocking portion (112*d*) in the form of a claw so that when the arm (112*b*) is moved from its inoperative position (shown in FIG. 4) to its operative position by actuation of the manually operable portion (112*e*), the interlocking portion (112*d*) engages with the claw wheel (104*a*) to stop rotation of the gear train.

As explained above, in accordance with the present invention, the coil frame for the motor coil in an electric clock is made of a plastic resilient material, and means for preventing a rotation of a row of gears of clock is integrally formed with the coil frame, so that a large number of independent component parts for use in stopping the second hand is not be required, the clock mechanism can be simplified in construction, the number of clock component parts and steps of assembling the same can be decreased thereby, resulting in a decreased manufacturing cost for the clock.

What is claimed is:

1. A hand stopping device for a timepiece having a second hand, a minute hand and an hour hand driven by a gear train which is driven by an electromechanical transducer, the improvement comprising: said transducer having a coil frame composed of plastic material, said coil frame having an integral winding portion on which a coil is wound, and an integral arm which has an integral manually operable portion and an integral interlocking portion, the arm being configured such that when said manually operable portion is operated, the arm moves from an inoperative position in which said interlocking portion is out of engagement with said gear train to an operative position in which said interlocking portion engages with one gear of said gear train so as to stop the motion of said gear train.

2. A device in accordance with claim 1; including means mounting said manually operable portion for displacement axially of said one gear so that said one gear is axially depressed as said manually operable portion is displaced.

3. A device in accordance with claim 2; wherein said manually operable portion is configured such that it may be displaced in a direction substantially crossing at a right angle with an axial direction of said one gear thereby causing said interlocking portion to be displaced in a direction substantially crossing at a right angle with said axial direction to engage with said one gear.

4. A device in accordance with claim 3; wherein said coil frame has an integral second arm, said second arm being disposed so as to be displaced in the same direction as that of said manually operable portion, and means coacting with said second arm for applying a clicking action thereto.

5. In a timepiece having an electromechanical transducer which has a coil wound on a coil frame for rotationally driving a gear train to thereby rotationally drive a second hand, a minute hand and an hour hand: a hand stopping device for temporarily stopping the rotational movement of the gear train to thereby temporarily stop the movement of the second hand, the device comprising an elongate flexible arm formed integrally with and projecting from said coil frame, the flexible arm having a manually operable portion effective when actuated to resiliently flex said arm from an inoperative position to an operative position, and an interlocking portion operable when said arm is flexed to its operative position to releasably interlock with a gear of said gear train to thereby stop the rotational movement of said gear train.

6. A timepiece according to claim 5; wherein said manually operable portion and said interlocking portion are formed integrally with said flexible arm.

7. A timepiece according to claim 5; wherein said coil frame and said flexible arm comprise a one-piece unitary structure.

8. A timepiece according to claim 5; wherein said coil frame, flexible arm, manually operable portion and interlocking portion jointly comprise a one-piece unitary structure.

9. A timepiece according to claim 8; wherein the one-piece unitary structure is comprised of plastic.

10. A timepiece according to claim 5; wherein said interlocking portion has a friction face for making frictional engagement with said gear to thereby stop the rotational movement of said gear train.

11. A timepiece according to claim 5; wherein said interlocking portion comprises a projection for engaging with projections on said gear to thereby stop the rotational movement of said gear train.

* * * * *